US005597118A

United States Patent [19]

Carter, Jr. et al.

[11] Patent Number: 5,597,118

[45] Date of Patent: Jan. 28, 1997

[54] DIRECT-OPERATED SPOOL VALVE FOR A FUEL INJECTOR

[75] Inventors: Jeffrey J. Carter, Jr.; Howard N. Cannon, both of Peoria; Kirk S. Shively, Dunlap; Glen F. Forck; Raj T. Nagarajan, both of Peoria; Steven F. Meister, Chillicothe, all of Ill.

[73] Assignee: Caterpillar Inc., Peoria, Ill.

[21] Appl. No.: 452,668

[22] Filed: May 26, 1995

[51] Int. Cl.[6] ..... F02M 51/00; F15B 13/044

[52] U.S. Cl. ..... 239/92; 137/625.65; 239/95

[58] Field of Search ..... 137/625.65; 239/88, 239/92, 95

[56] References Cited

U.S. PATENT DOCUMENTS

| | | | |
|---|---|---|---|
| 2,144,862 | 1/1939 | Truxell . | |
| 2,421,329 | 5/1947 | Hoffer | 210/166 |
| 2,434,586 | 1/1948 | Reynolds | 31/58 |
| 2,512,557 | 6/1950 | Weldy | 299/107.6 |
| 2,535,937 | 12/1950 | Bozec et al. | 299/107.6 |
| 2,552,445 | 5/1951 | Nielsen . | |
| 2,597,952 | 5/1952 | Rosenlund | 137/139 |
| 2,598,528 | 5/1952 | French . | |
| 2,621,011 | 12/1952 | Smith | 251/27 |
| 2,672,827 | 3/1954 | McGowen, Jr. | 103/232 |
| 2,727,498 | 12/1955 | Reiners | 123/32 |
| 2,749,181 | 6/1956 | Maxwell et al. | 299/107.6 |
| 2,916,048 | 12/1959 | Gunkel | 137/544 |
| 3,035,780 | 5/1962 | Peras | 239/453 |
| 3,057,560 | 10/1962 | Campbell | 239/464 |
| 3,071,714 | 1/1963 | Hadekel | 317/172 |
| 3,175,771 | 3/1965 | Bréting | 239/533 |
| 3,410,519 | 11/1968 | Evans | 251/141 |
| 3,532,121 | 10/1970 | Sturman et al. | 137/625.4 |
| 3,570,806 | 3/1971 | Sturman et al. | 251/65 |
| 3,570,807 | 3/1971 | Sturman et al. | 251/65 |
| 3,570,833 | 3/1971 | Sturman et al. | 267/161 |
| 3,585,547 | 6/1971 | Sturman et al. | 335/227 |
| 3,604,959 | 9/1971 | Sturman | 310/12 |
| 3,675,853 | 7/1972 | Lapera | 239/464 |
| 3,683,239 | 8/1972 | Sturman | 317/150 |
| 3,743,898 | 7/1973 | Sturman | 317/154 |
| 3,753,547 | 8/1973 | Topham | 251/120 |
| 3,807,441 | 4/1974 | Grosseau | 137/625.65 X |
| 3,814,376 | 6/1974 | Reinicke | 251/129 |
| 3,821,967 | 7/1974 | Sturman et al. | 137/624.15 |
| 3,835,829 | 9/1974 | Links | 123/139 E |
| 3,858,135 | 12/1974 | Gray | 335/266 |
| 3,989,066 | 11/1976 | Sturman et al. | 137/624.2 |
| 4,087,736 | 5/1978 | Mori et al. | 322/28 |

(List continued on next page.)

FOREIGN PATENT DOCUMENTS

| | | |
|---|---|---|
| 0425236A1 | 5/1991 | European Pat. Off. . |
| 0246373 | 3/1992 | European Pat. Off. . |
| 3234750A1 | 8/1983 | Germany . |
| 60-050269 | 3/1985 | Japan . |
| 60-067760 | 4/1985 | Japan . |
| 981664 | 12/1982 | U.S.S.R. . |
| 2022700 | 12/1979 | United Kingdom . |

OTHER PUBLICATIONS

Frankl, et al., "Electronic Unit Injectors–Revised," *SAE Technical Paper Series,* 40th Annual Earthmoving Industry Conference, Peoria, Illinois, (Apr. 11–13, 1989).

Roters,"Electromagnetic Devices," First Edition, pp. 44–45, 67, 70. (1941).

Sketch, "Fuel Injection Solenoid—Dual Latching," dated Sep. 3, 1992.

Caterpillar memorandum dated Aug. 30, 1994.

Sturman, "Breakthrough in Digital Valves," *Machine Design,* vol. 66, No. 4, dated Feb. 21, 1994, pp. 37–42.

*Primary Examiner*—Gerald A. Michalsky
*Attorney, Agent, or Firm*—William E. McCracken

[57] ABSTRACT

An actuation valve for a hydraulically-operated fuel injector includes an actuator having a plunger and a spool valve coupled to the plunger. The spool valve includes a high pressure port and is operable by the actuator to selectively place the high pressure port or the low pressure port in fluid communication with an injection mechanism of the injector.

14 Claims, 10 Drawing Sheets

U.S. PATENT DOCUMENTS

| | | | |
|---|---|---|---|
| 4,087,773 | 5/1978 | Jencks et al. | 335/243 |
| 4,107,546 | 8/1978 | Sturman et al. | 307/141 |
| 4,108,419 | 8/1978 | Sturman et al. | 251/30 |
| 4,114,647 | 9/1978 | Sturman et al. | 137/624.2 |
| 4,114,648 | 9/1978 | Nakajima et al. | 137/625.5 |
| 4,120,456 | 10/1978 | Kimura et al. | 239/464 |
| 4,152,676 | 5/1979 | Morgenthaler et al. | 333/24.1 |
| 4,182,492 | 1/1980 | Albert et al. | 239/92 |
| 4,189,816 | 2/1980 | Chalansonnet | 29/148.4 |
| 4,192,466 | 3/1980 | Tanasawa et al. | 239/464 |
| 4,231,525 | 11/1980 | Palma | 239/585 |
| 4,248,270 | 2/1981 | Ostrowski | 138/45 |
| 4,266,727 | 5/1981 | Happel et al. | 239/4009 |
| 4,273,291 | 6/1981 | Müller | 239/533.12 |
| 4,275,693 | 6/1981 | Leckie | 123/447 |
| 4,308,891 | 1/1982 | Loup | 137/551 |
| 4,354,662 | 10/1982 | Thompson | 251/129 |
| 4,375,274 | 3/1983 | Thoma et al. | 239/117 |
| 4,392,612 | 7/1983 | Deckard et al. | 239/88 |
| 4,396,037 | 8/1983 | Wilcox | 137/625.65 |
| 4,409,638 | 10/1983 | Sturman et al. | 361/152 |
| 4,482,094 | 11/1984 | Knape | 239/88 |
| 4,501,290 | 2/1985 | Sturman et al. | 137/495 |
| 4,516,600 | 5/1985 | Sturman et al. | 137/495 |
| 4,518,147 | 5/1985 | Andresen et al. | 251/121 |
| 4,526,519 | 7/1985 | Mowbray et al. | 417/490 |
| 4,541,454 | 9/1985 | Sturman et al. | 137/505 |
| 4,558,844 | 12/1985 | Donahue et al. | 251/118 |
| 4,610,428 | 9/1986 | Fox | 251/129.16 |
| 4,653,455 | 3/1987 | Eblen et al. | 123/506 |
| 4,655,254 | 4/1987 | Hafner et al. | 137/625.65 |
| 4,658,824 | 4/1987 | Scheibe | 123/4742 |
| 4,702,212 | 10/1987 | Best et al. | 123/472 |
| 4,721,253 | 1/1988 | Noguchi et al. | 239/464 |
| 4,722,364 | 2/1988 | Kubach et al. | 137/625.65 |
| 4,753,416 | 6/1988 | Inagaki et al. | 251/129.15 |
| 4,794,890 | 1/1989 | Richeson, Jr. | 123/90.11 |
| 4,811,221 | 3/1989 | Sturman et al. | 364/420 |
| 4,812,884 | 3/1989 | Mohler | 335/258 |
| 4,813,599 | 3/1989 | Greiner et al. | 239/456 |
| 4,831,989 | 5/1989 | Haines | 123/506 |
| 4,846,440 | 7/1989 | Carlson et al. | 251/129.17 |
| 4,875,499 | 10/1989 | Fox | 137/82 |
| 4,893,102 | 1/1990 | Bauer | 335/132 |
| 4,893,652 | 1/1990 | Nogle et al. | 137/596.17 |
| 4,928,887 | 5/1990 | Miettaux | 239/584 |
| 4,964,571 | 10/1990 | Taue et al. | 239/88 |
| 4,993,637 | 2/1991 | Kanesaka | 239/96 |
| 5,004,577 | 4/1991 | Ward | 264/112 |
| 5,042,445 | 8/1991 | Peters et al. | 123/446 |
| 5,049,971 | 9/1991 | Krumm | 357/55 |
| 5,050,543 | 9/1991 | Kawamura | 123/90.1 |
| 5,110,087 | 5/1992 | Studtmann et al. | 251/129.16 |
| 5,121,730 | 6/1992 | Ausman et al. | 123/467 |
| 5,131,624 | 7/1992 | Kreuter et al. | 251/129.18 |
| 5,161,779 | 11/1992 | Graner et al. | 251/129.16 |
| 5,188,336 | 2/1993 | Graner et al. | 251/129.16 |
| 5,191,867 | 3/1993 | Glassey | 123/446 |
| 5,339,777 | 8/1994 | Cannon | 123/90.12 |
| 5,375,576 | 12/1994 | Ausman et al. | 123/446 |
| 5,407,131 | 4/1995 | Maley et al. | 239/90 |
| 5,460,329 | 10/1995 | Sturman | 239/88 |
| 5,479,901 | 1/1996 | Gibson et al. | 137/625.65 |
| 5,494,219 | 2/1996 | Maley et al. | 239/88 |

DIRECT-OPERATED SPOOL VALVE FOR A FUEL INJECTOR

TECHNICAL FIELD

The present invention relates generally to fluid valves, and more particularly to an actuable valve for operating a fluid control device, such as a fuel injector.

BACKGROUND ART

Actuation valves are often employed to operate fluid control devices, for example fuel injectors used in internal combustion engines. One type of actuation valve includes a solenoid and a three-way poppet valve which controls the admittance of pressurized fluid, e.g., engine oil or engine fuel, into an intensifier chamber. The pressurized fluid acts against the intensifier piston so that the piston is displaced in a direction which causes fuel located in a high pressure chamber to be pressurized. The pressurized fuel in turn acts against a spring-biased check and, when the pressure of the fuel rises to a high enough level, the check is opened and the fuel is injected into an associated combustion chamber.

While such actuation valves have generally been found to operate satisfactorily in most applications, there are some engine applications where the injector must be operated at speeds which cannot be accommodated by a poppet-type valve.

DISCLOSURE OF THE INVENTION

A valve according to the present invention is capable of fast operation and is desirably small and light in weight as compared with prior valves.

According to one aspect of the present invention, an actuation valve for a hydraulically-operated fuel injector having an injection mechanism includes an actuator having a plunger and a spool valve coupled to the plunger. The spool valve includes a high pressure port and a low pressure port and is operable by the actuator to selectively place the high pressure port or the low pressure port in fluid communication with the injection mechanism.

Preferably, the spool valve includes a body having a main valve bore, a spool disposed in the main valve bore and coupled to the plunger, a first passage coupled between the main valve bore and the high pressure port, a second passage coupled between the main valve bore and the low pressure port and a third passage coupled between the main valve bore and the injection mechanism.

Also preferably, the spool includes at least one land and is movable by the actuator to cause the at least one land to block fluid communication between the first and third passages or to block fluid communication between the second and third passages.

In accordance with a specific embodiment, the spool is movable to a first position when the actuator is actuated and further includes means for moving the spool toward a second position when the actuator is deactuated. The moving means preferably includes a spring and may further include means for hydraulically assisting movement of the spool from the first position to the second position. The spring may be disposed in a spring chamber and the hydraulically assisting means preferably comprises a passage coupled between an outlet port of the spool valve and the spring chamber for introducing high pressure fluid therein.

Still further, the actuator may comprise a solenoid having a movable armature coupled to the plunger.

According to a further aspect of the present invention, an actuation valve for a hydraulically-operated fuel injector having an intensifier piston disposed in an intensifier chamber includes an actuator having a plunger and a spool valve having a high pressure port, a low pressure port, an outlet port coupled to the intensifier chamber and a spool. The spool is movable to a first position by the actuator when the actuator is energized and is also movable to a second position when the actuator is deenergized to selectively place the high pressure port or the low pressure port in fluid communication with the outlet port and the intensifier piston. Means are provided for moving the spool from the first position to the second position when the actuator is deenergized.

In accordance with yet another aspect of the present invention, an actuation valve for a hydraulically-operated fuel injector having an intensifier piston disposed in an intensifier chamber includes a solenoid having a solenoid winding and a movable armature coupled to a plunger and a spool valve having a high pressure port, a low pressure port, an outlet port coupled to the intensifier chamber and a spool. The spool is movable to a first position by the solenoid when the solenoid winding is energized and is also movable to a second position when the solenoid winding is deenergized to selectively place the high pressure port or the low pressure port in fluid communication with the outlet port and the intensifier piston. A high pressure fluid source is coupled to the high pressure port and a low pressure fluid source is coupled to the low pressure port. A spring is disposed in a spring chamber in contact with an end of the spool. The spool includes a first land having one side in fluid communication with the spring chamber and a second side in fluid communication with the low pressure port when the spool is in the first position. A second land blocks the outlet port from the low pressure port when the spool is in the first position and blocks the outlet port from the high pressure port when the spool is in the second position. A passage extends between the outlet port and the spring chamber for conducting high pressure to the one side of the first land to assist the spring in moving the spool from the first position to the second position.

By utilizing a spool valve rather than a poppet type valve and by providing hydraulic assist of the spool, faster response times can be achieved with lower actuation force, thereby permitting an inexpensive actuator to be used.

BEST MODE FOR CARRYING OUT THE INVENTION

Figure 1:
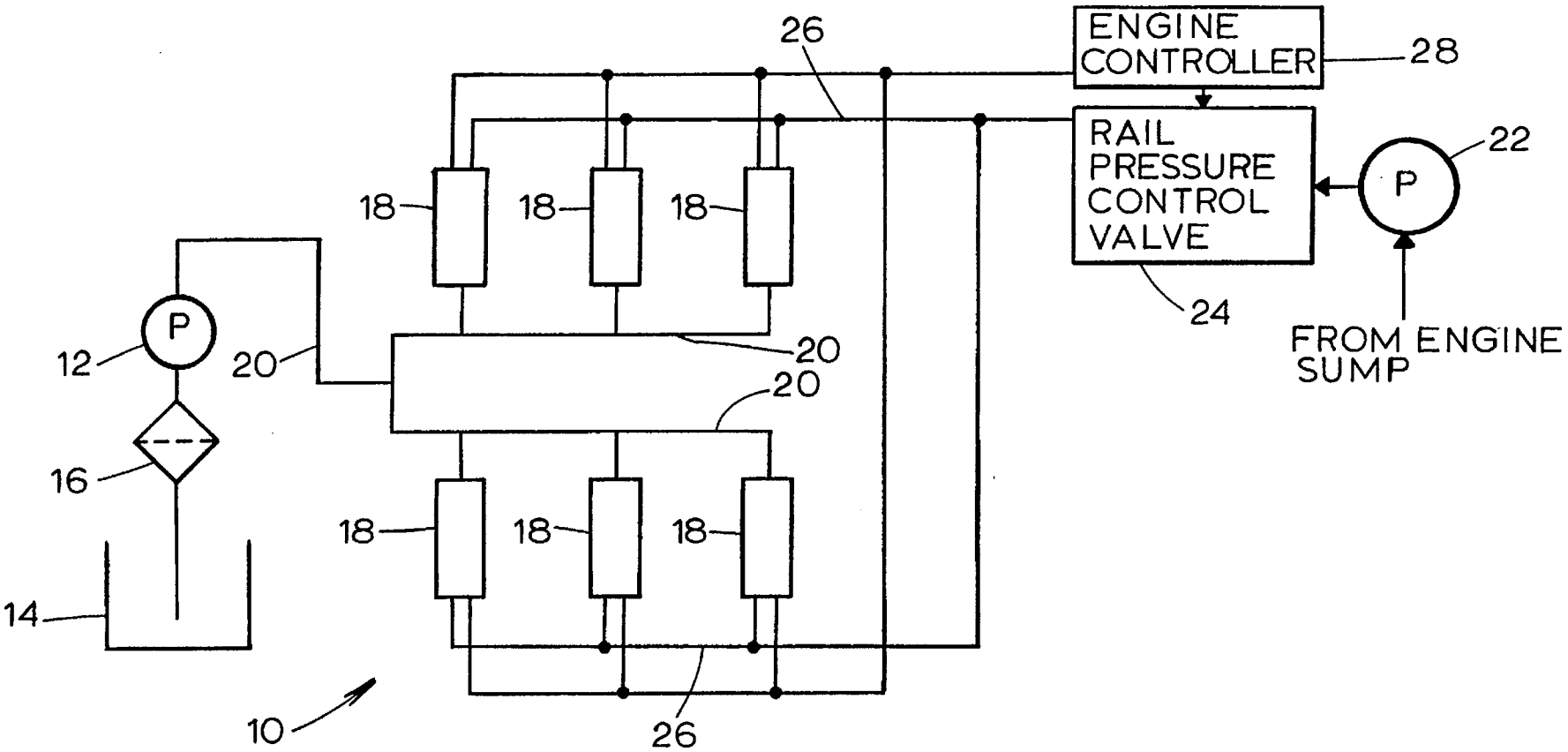
FIG. 1 comprises a combined schematic and block diagram of a fuel injection system.

Referring now to FIG. 1, a hydraulically-actuated, electronically-controlled unit injector (HEUI) system 10 includes a transfer pump 12 which receives fuel from a fuel tank 14 and a filter 16 and delivers same at a relatively low pressure of, for example, about 0.414 MPa (60 p.s.i.), to fuel injectors 18 via fuel rail lines or conduits 20. An actuating fluid, such as engine oil supplied from an engine sump, is pressurized by a pump 22 to a nominal intermediate pressure of, for example, 20.7 MPa (3,000 p.s.i.). A rail pressure control valve 24 may be provided to modulate the oil pressure provided over oil rail lines or conduits 26 to the injectors 18 in dependence upon the level of a signal supplied by an electronic engine controller 28. In response to electrical control signals developed by the engine controller 28, the fuel injectors 18 inject fuel at a high pressure of, for example, 138 MPa (20,000 p.s.i.) or greater, into associated combustion chambers or cylinders (not shown) of an internal combustion engine. While six fuel injectors 18 are shown in FIG. 1, it should be noted that a different number of fuel injectors may alternatively be used to inject fuel into a like number of associated combustion chambers. Also, the engine with which the fuel injection system 10 may be used may comprise a diesel-cycle engine, an ignition assisted engine or any other type of engine where it is necessary or desirable to inject fuel therein.

If desired, the fuel injection system 10 of FIG. 1 may be modified by the addition of separate fuel and/or oil supply lines extending between the pumps 12 and 22 and each injector 18. Alternatively, or in addition, fuel or any other fluid may be used as the actuating fluid and/or the timing and injection duration of the injectors may be controlled by mechanical or hydraulic apparatus rather than the engine controller 28, if desired.

Figure 2A:
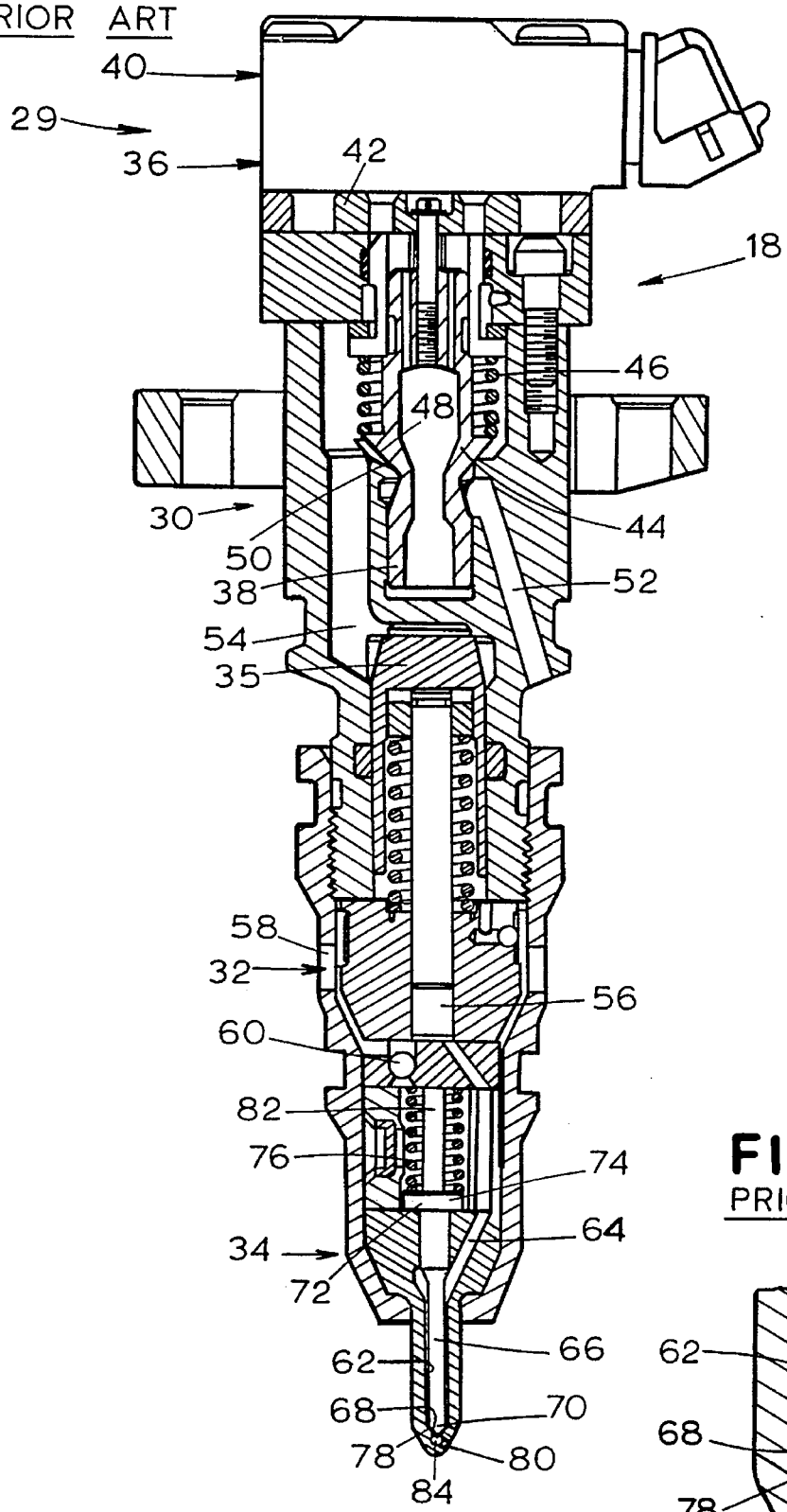
FIG. 2A PRIOR ART
FIG. 2A comprises an elevational view, partly in section, of a prior art fuel injector.
Figure 2B:
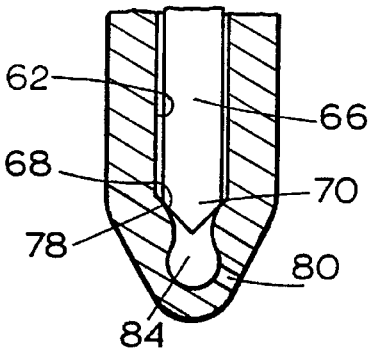
FIG. 2B PRIOR ART
FIG. 2B comprises an enlarged, fragmentary sectional view of the tip of the injector shown in FIG. 2A.
Figure 3:
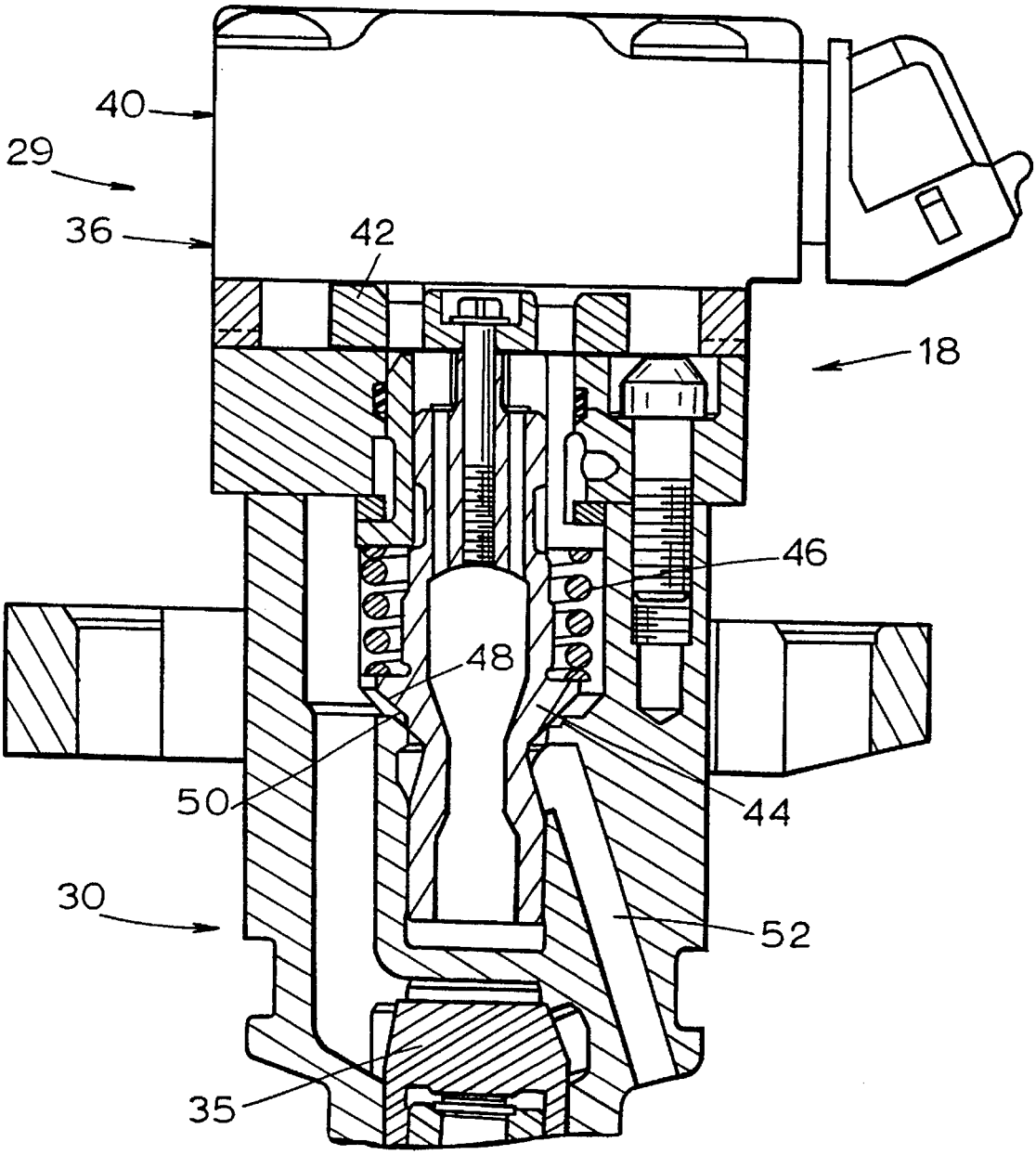
FIG. 3 PRIOR ART
FIG. 3 comprises an enlarged, fragmentary sectional view of the fuel injector of FIG. 2.

FIGS. 2A, 2B and 3 illustrate a prior art fuel injector 18 which is usable with the fuel injection system 10 of FIG. 1. The fuel injector is disclosed in Glassey U.S. Pat. No. 5,191,867 and reference should be had thereto for a full description of the injector. The fuel injector 18 includes an actuator and valve assembly 29, a body assembly 30, a barrel assembly 32 and a nozzle and tip assembly 34. The actuator and valve assembly 29 acts as a means for selectively communicating either relatively high pressure oil or low pressure oil to an intensifier piston 35. The actuator and valve assembly 29 includes an actuator 36, preferably in the form of a solenoid assembly, and a valve 38, preferably in the form of a poppet valve. The solenoid assembly 36 includes a fixed stator assembly 40 and a movable armature 42 coupled to a poppet 44 of the valve 38.

When the actuator 36 is deenergized, a spring 46 biases the poppet 44 so that a sealing surface 48 of the poppet 44 is disposed in sealing contact with a valve seat 50. Consequently, an oil inlet passage 52 is taken out of fluid communication with an intensifier chamber 54. When fuel injection is to commence the actuator 36 is energized by an electrical control signal developed by the engine controller 28, causing the poppet 44 to be displaced upwardly and spacing the sealing surface 48 from the valve seat 50. Pressurized oil then flows from the oil inlet passage 52 into the intensifier chamber 54. In response to the admittance of pressurized fluid into the chamber 54, the intensifier piston 35 is displaced downwardly, thereby pressurizing fuel drawn into a high pressure chamber 56 through a fuel inlet 58 and a check valve 60. The pressurized fuel is supplied to a check bore 62 through passages 64. An elongate check 66 is disposed in the check bore 62 and, as seen most clearly in FIG. 2B, includes a sealing tip 68 disposed at a first end portion 70 and an enlarged plate or head 72 disposed at a second end portion 74. A spring 76 biases the tip 68 against a valve seat 78 to isolate the check bore 62 from one or more nozzle orifices 80.

Figure 4:
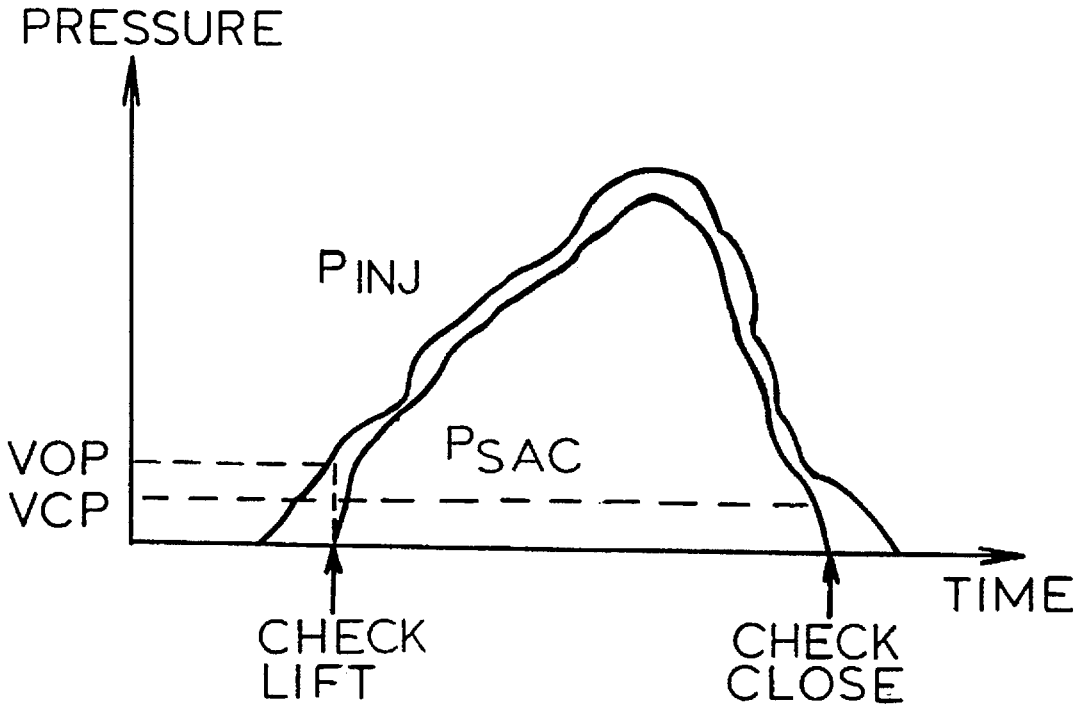
FIG. 4 PRIOR ART
FIG. 4 comprises a graph illustrating the operation of the fuel injector of FIGS. 2 and 3.

Referring also to FIG. 4, when the pressure $P_{INJ}$ within the check bore 62 reaches a selected valve opening pressure (VOP), check lift occurs, thereby spacing the tip 68 from the valve seat 78 and permitting pressurized fuel to escape through the nozzle orifice 80 into the associated combustion chamber. The pressure VOP is defined as follows:

$$VOP = \frac{S}{A1 - A2}$$

where S is the load exerted by the spring 76, A1 is the cross-sectional dimension of a valve guide 82 of the check 66 and A2 is the diameter of the line defined by the contact of the tip 68 with the valve seat 78.

At and following the moment of check lift, the pressure $P_{SAC}$ in an injector tip chamber 84 increases and then decreases in accordance with the pressure $P_{INJ}$ in the check bore 62 until a selected valve closing pressure (VCP) is reached, at which point the check returns to the closed position. The pressure VCP is determined in accordance with the following equation:

$$VCP = \frac{S}{A1}$$

where S is the spring load exerted by the spring 76 and A1 is the cross-sectional diameter of the guide portion 82, as noted previously.

As the foregoing discussion demonstrates, the force developed by the actuator 36 must overcome the bias force of the spring 46 and the inertia of the poppet 44. Thus, the actuator 36 must develop a relatively high actuating force and must be capable of rapidly moving a relatively high mass poppet in order to obtain proper operation. This results in the need to utilize an actuator 36 which is relatively large and robust.

Figure 5:
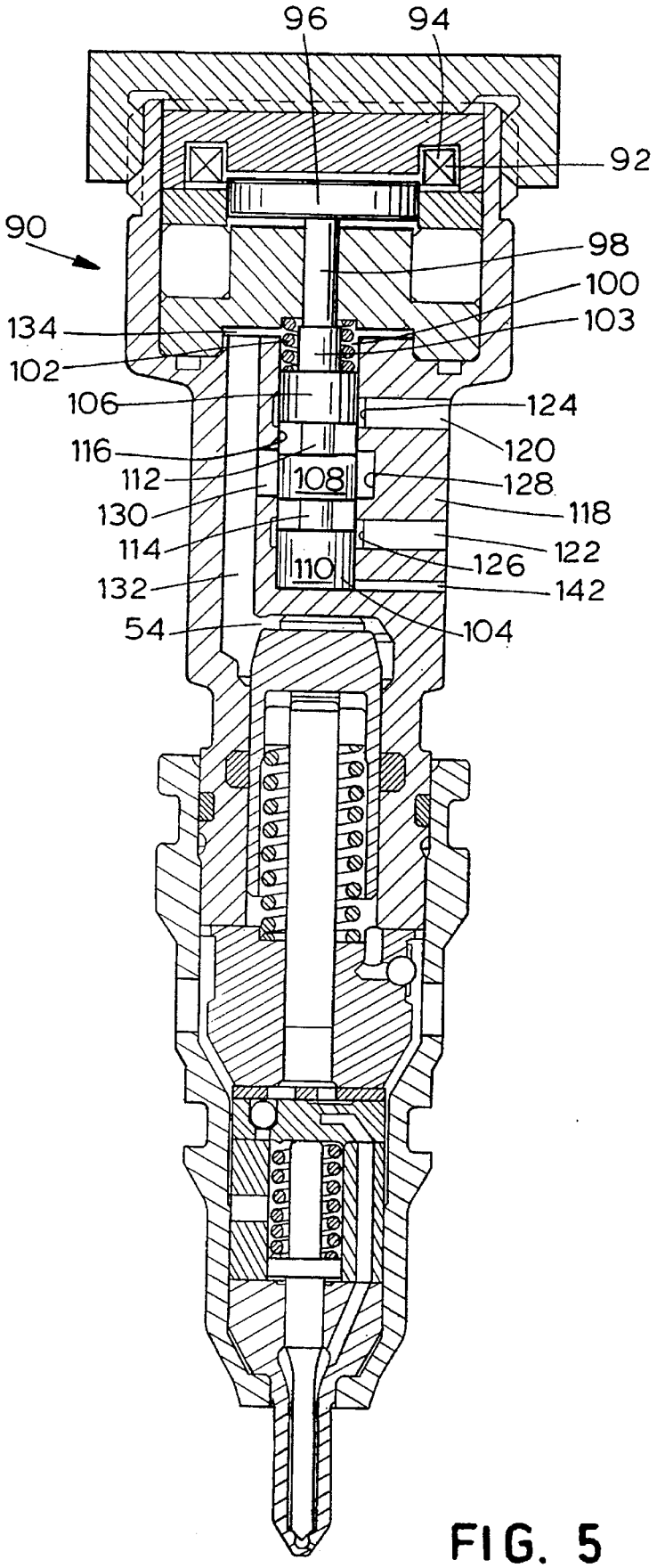
FIG. 5 is a view similar to FIG. 2A of a fuel injector incorporating the valve of the present invention.
Figure 6:
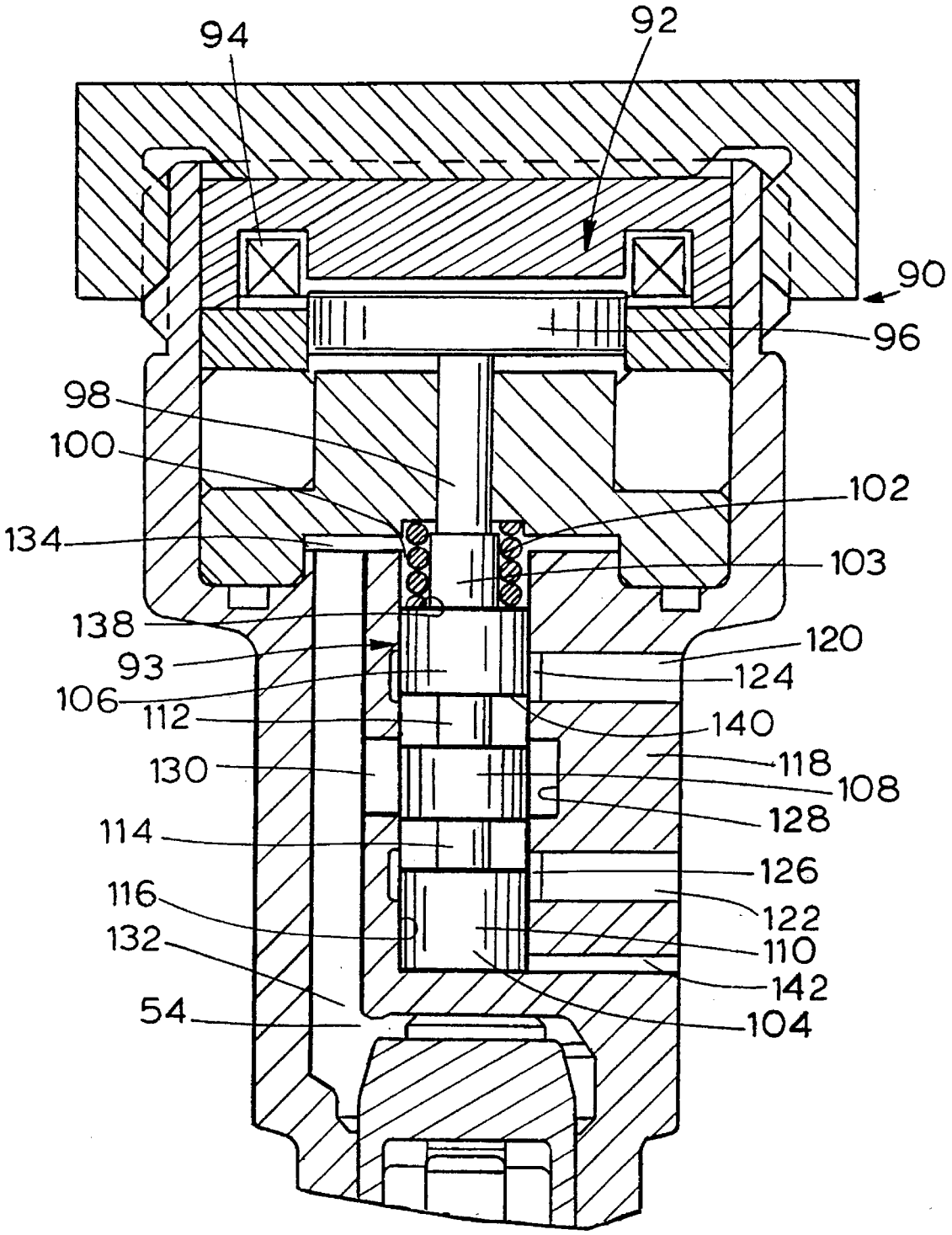
FIG. 6 is a view similar to FIG. 3 illustrating the valve of the present invention in first valve position.
Figure 7:
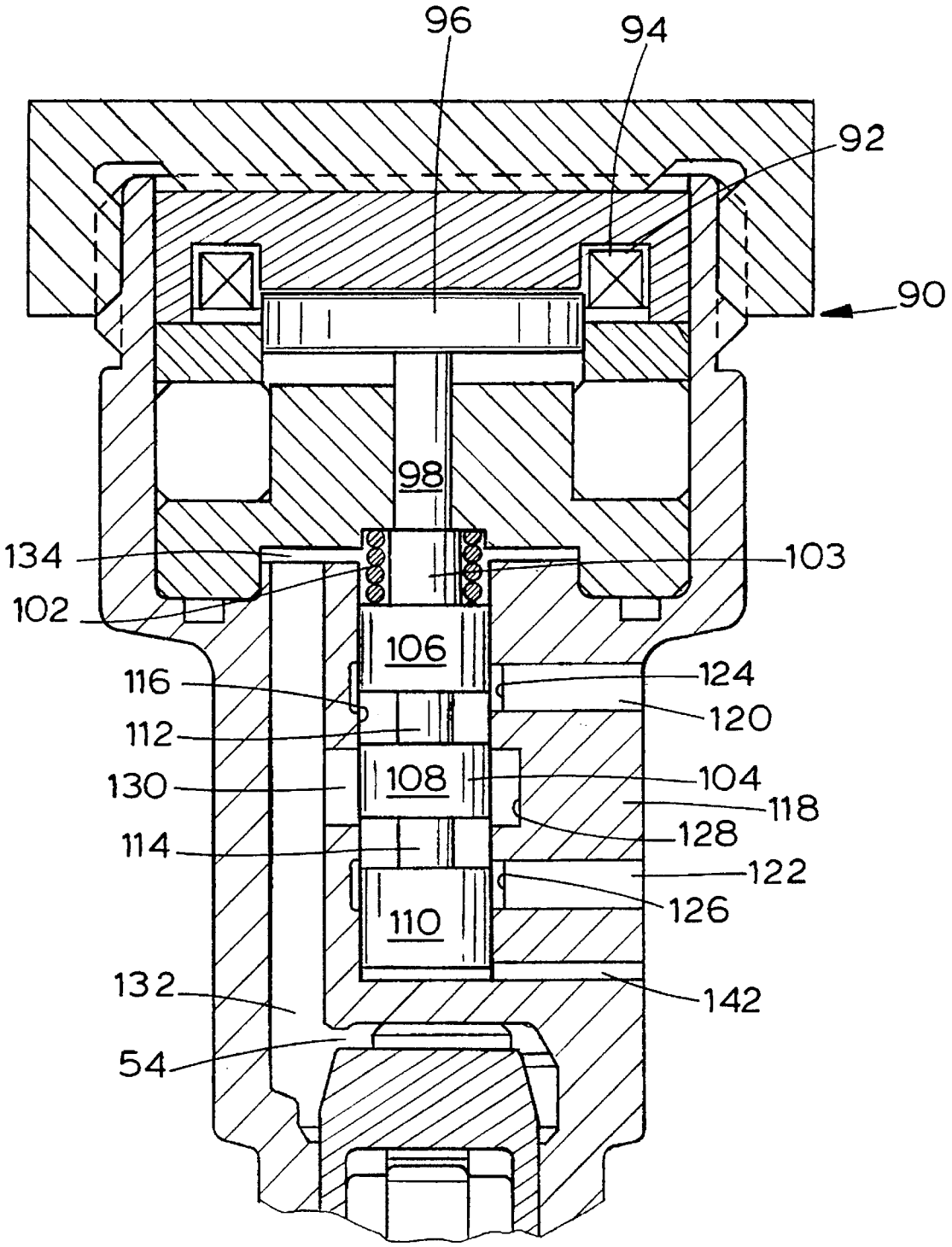
FIG. 7 is an enlarged fragmentary sectional view of the valve of FIG. 5 in a second valve positions.

FIGS. 5–7 illustrate a first embodiment of an actuator and valve assembly 90 which may be used in place of the actuator and valve assembly 29 in the fuel injector illustrated in FIGS. 2 and 3. As noted in greater detail hereinafter, an important part of the present invention is the provision of a hydraulic assist of a valve element. This hydraulic assist leads to significant advantages in terms of operation cost. Further, the present invention does not utilize a poppet, and hence noise and pump requirements may be reduced and efficiency increased.

The assembly 90 includes an actuator 92, which may comprise a solenoid having a solenoid winding 94, an armature 96 and a plunger 98 coupled to the armature 96 and movable therewith. The plunger 98 extends into a spring chamber 100 within which a spring 102 is disposed. A reduced diameter portion 103 of a spool 104 is formed at an end of the plunger 98 within the spring chamber 100. The spring 102 surrounds the reduced diameter portion 103 and bears against a first land 106 of the spool 104. The spool 104 further includes second and third lands 108, 110 separated by reduced diameter portions 112, 114. The spool 104 is disposed in a valve bore 116 located in a body 118. First and second passages 120, 122 defining low and high pressure ports, respectively, are connected to a low pressure source, such as engine sump, and a high pressure source, such as the rail pressure control valve 24, respectively. The passages 120, 122 are also disposed in fluid communication with a first annulus 124 and a second annulus 126, respectively, surrounding the valve bore 116. A third annulus 128 also surrounds the valve bore 116 and is coupled by a third passage 130 defining an outlet port to a fourth passage 132. The passage 132 is coupled to the intensifier chamber 54 and is further coupled to the spring chamber 100 via a space 134 between the actuator 92 and the body 118.

INDUSTRIAL APPLICABILITY

When the solenoid winding 94 is deenergized, the armature 96 and the spool 104 are in the positions shown in FIGS. 5 and 6 wherein the land 108 blocks fluid communication between the passage 130 and the passage 122. In addition, the passage 130 is placed in fluid communication with the passage 120, and hence the passage 132 and the intensifier chamber 54 are coupled to engine sump. During this time, the spring 102 exerts a biasing force which maintains the spool 104 in such position.

When the solenoid winding 94 is energized, the spool moves upwardly against the force of the spring 102 to the position shown in FIG. 7. As a result of movement to this position, the land 108 blocks fluid communication between the passages 120 and 130 and permits fluid communication between the passages 122 and 132. Thus, high pressure oil or other actuating fluid is permitted to flow into the passage 132 to the intensifier chamber 54 so that fuel injection can commence. Also, high pressure fluid is admitted into the spring chamber 100 through the space 134. During this time, a fluid pressure imbalance is created across the land 106 owing to the high pressure fluid in contact with a first end 138 thereof and the low pressure fluid in the passage 120 which is in contact with a second end 140. Thus, when the solenoid winding 94 is subsequently deenergized, the bias exerted by the spring 102 and the force created by the fluid pressure imbalance across the land 106 together move the spool 104 downwardly back to the position shown in FIGS. 5 and 6.

A weep hole 142 is provided in fluid communication with the lowermost end of the valve bore 116 to evacuate such bore and prevent lockup of the spool 104 therein during movement to the position shown in FIGS. 5 and 6. Also, by approximately sizing the weep hole 142, hydraulic dampening of the spool 104 can be accomplished so that noise is reduced.

Significantly, the land 108 is wider than the width of the annulus 128, and the passage 130, and hence there is no time at which the low and high pressure ports defined by the passages 120, 122 are in fluid communication with one another. Consequently, as compared to a poppet-type valve, oil consumption is reduced and hence an oil pump having a lesser capacity can be used. Also, energy losses are reduced and hence efficiency is increased.

It should be noted that a spool other than one having three lands might alternatively be used in the present invention. The lands 106, 110 primarily serve to guide the spool 104 for axial movement in the valve bore 116 while, as previously noted, the land 106 also provides the mechanism for hydraulic assist in moving the spool 104 to the lowermost position shown in FIGS. 5 and 6. By providing this hydraulic assist, a spring 102 having a relatively low spring rate can be used, thereby permitting the force that must be developed by the actuator 92 to be reduced. If this consideration is not important, the hydraulic assist aspect of the present invention may be omitted, in which case the land 106 would not be necessary except for assistance in guiding the spool travel. If such guiding can be accomplished in a different fashion, the lands 106, 110 may be omitted.

Further, instead of the single-piece armature and spool arrangement shown in FIGS. 5–7, a multi-piece arrangement may be used. Still further, the solenoid may be designed to move downwardly rather than upwardly when actuated.

Figure 8:
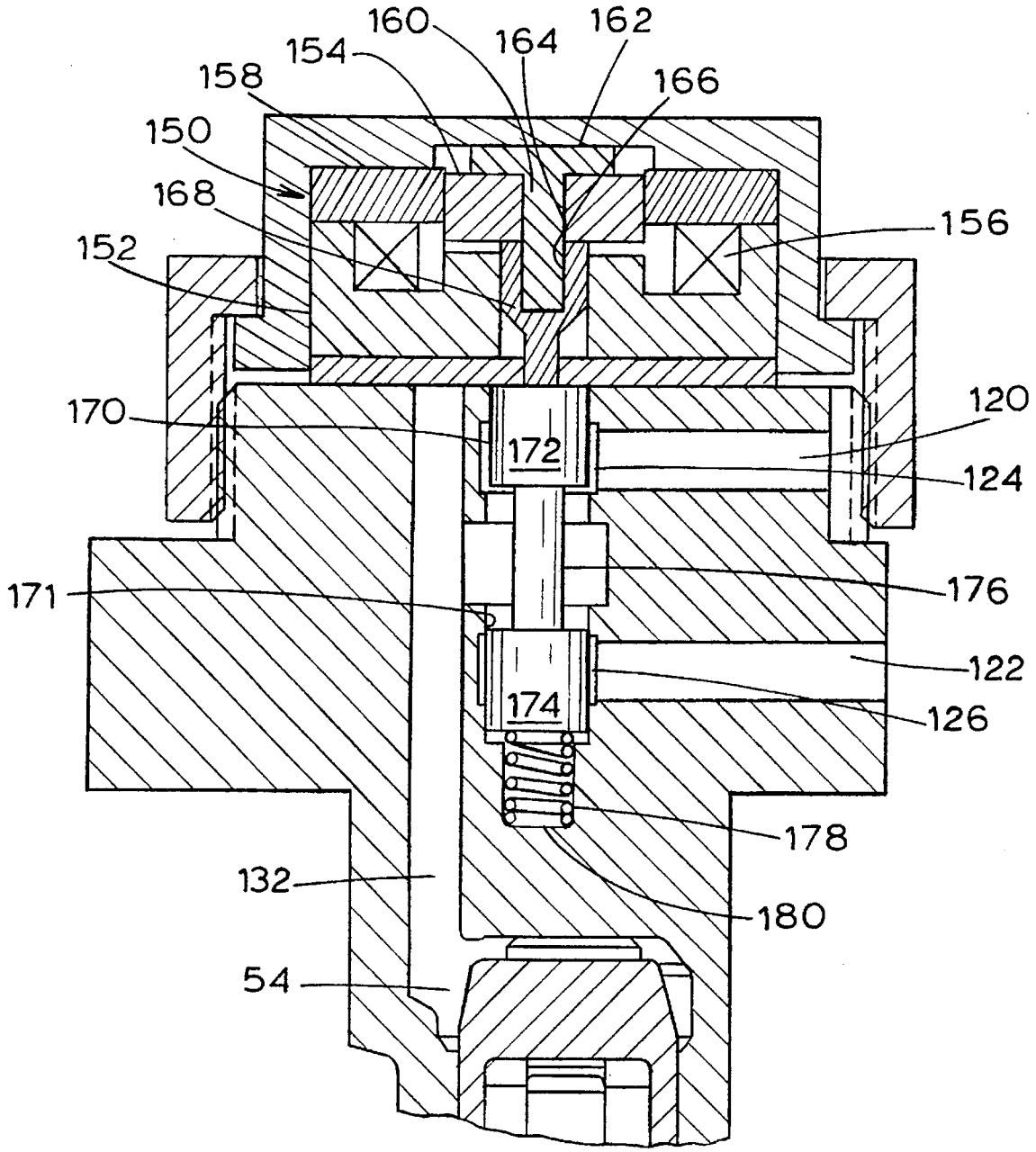
FIG. 8 is a view similar to FIG. 6 illustrating an alternative embodiment of the present invention.

FIG. 8 illustrates a further embodiment incorporating the above-described alternatives. Elements common to FIGS. 5–8 are assigned like reference numerals. The actuator 92 of FIGS. 5–7 is replaced by an actuator 150 having a stator 152, an armature 154, a solenoid winding 156 and a spacer 158 fabricated of magnetically permeable material and within which the armature 154 is axially movable. A pin 160 having an enlarged head 162 is press-fitted or otherwise secured within a bore 164 in the armature 154 and extends downwardly into a blind bore 166 in a plunger 168. The pin 160 may loosely fit within the bore 166 or may be secured therein. The plunger 168 bears against a spool 170 disposed in a valve bore 171 and having two lands 172, 174 joined by a reduced diameter portion 176. A return-spring 178 is disposed in a spring cavity 180 located below the land 174.

When the actuator 150 is deenergized, the spool 170 is forced upwardly by the spring 178 to the position shown in FIG. 8 so that the passage 120 is in fluid communication with the passage 132. When the actuator 150 is energized, the armature 154, the pin 160, the plunger 168 and the spool 170 are moved downwardly against the force of the spring 178 so that fluid communication between the passages 120, 132 is blocked and fluid communication between the passages 122, 132 is thereafter established.

When the actuator 150 is again deenergized, the spring 178 returns the spool 170 upwardly to the position shown in FIG. 8. As before, fluid communication between the passages 122, 132 is preferably blocked before fluid communication between the passages 120, 132 is established.

As in the preceding embodiment, a weep hole may be included in fluid communication with the spring cavity 180 to prevent hydraulic lock-up and provide dampening of the spool 170. Also, hydraulic assist of the return movement of the spool to the upper position may be effected by adding a passage between the passage 132 and the spring cavity 180.

Figure 9:
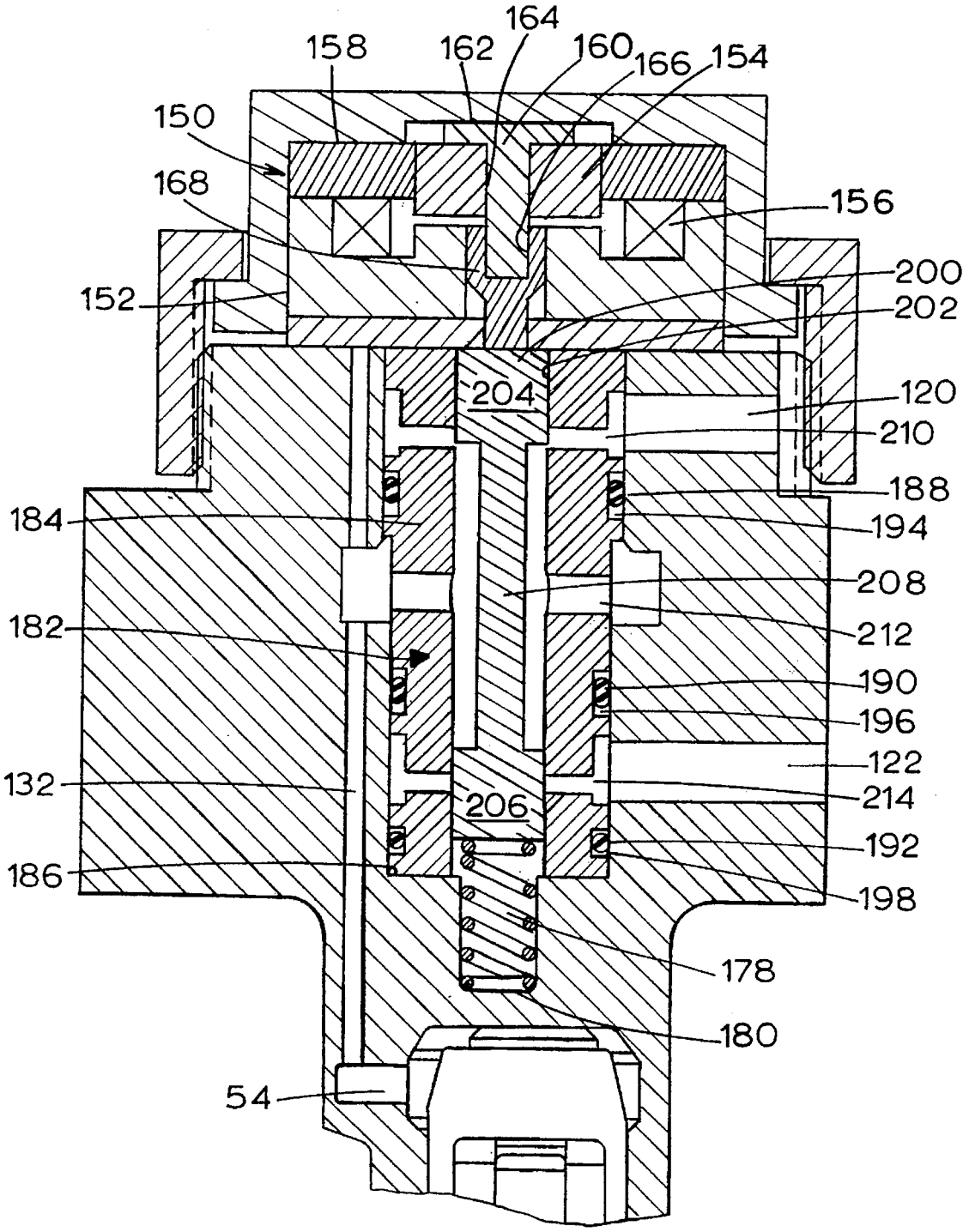
FIGS. 9 and 10 are views similar to FIG. 8 illustrating further alternative embodiments of the present invention.
Figure 10:
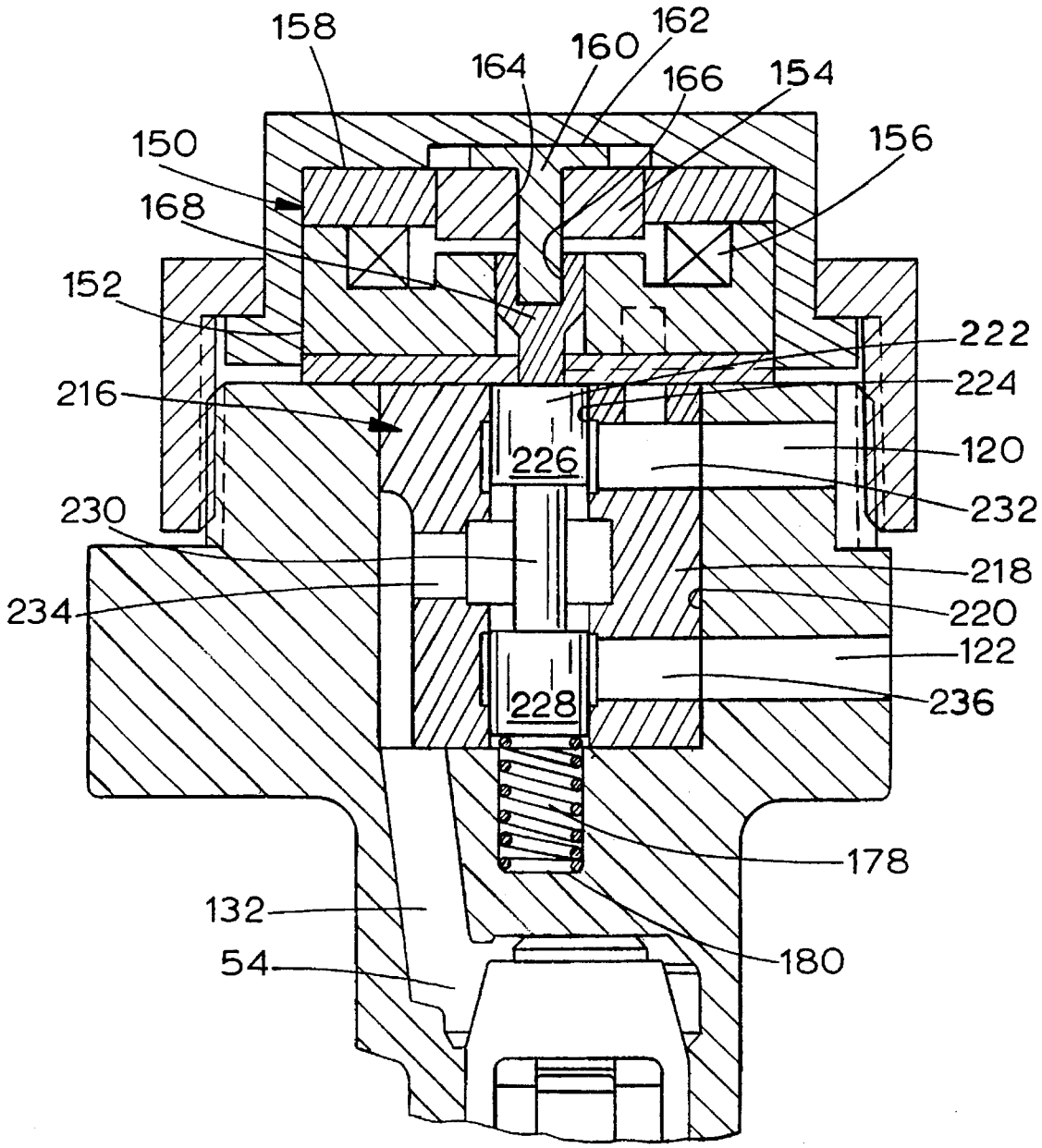

FIGS. 9 and 10 illustrate two further alternative embodiments of the present invention. Elements common to FIGS. 5–10 are assigned like reference numerals. In the embodiment of FIG. 9, the spool 170 in the valve bore 171 is replaced by a drop-in cartridge valve 182 having a cartridge body 184 disposed within a valve bore 186. Three O-rings 188, 190, 192 are disposed in circumferential channels 194, 196, 198, respectively, and provide sealing. A spool 200 is disposed within a spool bore 202 in the cartridge body 184 and includes two lands 204, 206 separated by an intermediate reduced-diameter portion 208. The cartridge body 184 further includes three passages 210, 212, 214 that are in fluid communication with the passages 120, 132, and 122, respectively.

The embodiment of FIG. 9 operates in a similar fashion to the embodiment of FIG. 8. That is, when the solenoid winding 156 is actuated, the armature 154, the pin 160, the plunger 168 and the spool 200 are moved downwardly to connect the passage 122 to the passage 132 and to isolate the passage 120 from the passage 132. When the solenoid winding 156 is deactuated, the return-spring 178 moves the spool 200 upwardly so that the land 206 blocks the passage 122 from the passage 132 and so that the land 204 is moved to establish fluid communication between the passages 120 and 132.

In the embodiment of FIG. 10, a press-in cartridge valve 216 is substituted for the drop-in cartridge valve 182 of FIG. 9. The press-in cartridge valve 216 includes a cartridge body 218 press-fitted into a valve bore 220 and a spool 222 disposed within a spool bore 224 in the cartridge body 218. The spool 222 includes two lands 226, 228 separated by a reduced-diameter portion 230. The cartridge body 218 further includes three passages 232, 234, 236 that are in fluid communication with the passages 120, 132, and 122, respectively.

The embodiment of FIG. 10 operates in similar fashion to the embodiments of FIGS. 8 and 9 previously described. However, because the cartridge body 218 is press-fitted within the valve bore 220, no sealing devices, such as the O-rings 188, 190 and 192 of FIG. 9 are required, and hence the length of the press-in cartridge valve 216 may be reduced without loss of sealing efficiency.

The present invention comprehends the use of a spool valve or other type of valve instead of a poppet valve in a HEUI injector. Such a valve allows faster actuation time with lower actuation force, thereby aiding injector performance.

Numerous modifications and alternative embodiments of the invention will be apparent to those skilled in the art in view of the foregoing description. Accordingly, this description is to be construed as illustrative only and is for the purpose of teaching those skilled in the art the best mode of carrying out the invention. The details of the structure may be varied substantially without departing from the spirit of the invention, and the exclusive use of all modifications which come within the scope of the appended claims is reserved.

We claim:

1. In combination:

an actuation valve for a hydraulically-operated fuel injector having an injection mechanism, comprising an actuator having a plunger and a spool valve coupled to the plunger and having a high pressure port and a low pressure port and operable by the actuator to selectively place the high pressure port or the low pressure port in fluid communication with the injection mechanism, the spool valve including a body having a valve bore, a spool disposed in the valve bore and coupled to the plunger, a first passage coupled between the valve bore and the high pressure port, a second passage coupled between valve bore and the low pressure port and a third passage coupled between the valve bore and the injection mechanism wherein the spool is alternately and repetitively movable during normal operation of the actuation valve between a first position when the actuator is actuated and a second position when the actuator is deactuated; and a high pressure fluid source coupled to the high pressure port and a low pressure fluid source coupled to the low pressure port;

wherein the spool valve further includes a spring and means operable in cooperation with the spring for hydraulically assisting movement of the spool each time the spool moves from the first position to the second position.

2. The combination of claim 1, wherein the spool includes at least one land and is movable by the actuator to cause the at least one land to block fluid communication between the first and third passages or to block fluid communication between the second and third passages.

3. The combination of claim 1, wherein the spool includes three lands and is movable by the actuator to cause at least one of the lands to block fluid communication between the first and third passages or to block fluid communication between the second and third passages.

4. The combination of claim 1, wherein the spring is disposed in a spring chamber and the spool valve includes an outlet port and wherein the hydraulically assisting means comprises a passage coupled between the outlet port and the spring chamber for introducing high pressure fluid into the spring chamber.

5. The combination of claim 1, wherein the actuator comprises a solenoid having a movable armature coupled to the plunger.

6. The actuation valve of claim 1, wherein the spool valve comprises an insertable valve assembly.

7. The actuation valve of claim 6, wherein the insertable valve assembly comprises a cartridge body having an outer surface and a plurality of sealing devices disposed in a corresponding plurality of circumferential channels situated in the cartridge body outer surface.

8. The actuation valve of claim 6, wherein the insertable valve assembly comprises a cartridge body press-fitted in a bore.

9. An actuation valve for a hydraulically-operated fuel injector having an intensifier piston disposed in an intensifier chamber, comprising:

an actuator having a plunger;

a spool valve having a high pressure port, a low pressure port, an outlet port coupled to the intensifier chamber and a spool alternately and repetitively movable during normal operation of the actuator between a first position and a second position when the actuator is alternately energized and deenergized, respectively, to selectively place the high pressure port or the low pressure port in fluid communication with the outlet port and the intensifier piston; and means for moving the spool from the first position to the second position when the actuator is deenergized including means for creating a fluid pressure imbalance across at least a portion of the spool each time the actuator is energized.

10. The actuation valve of claim 9, wherein the moving means comprises a spring.

11. The actuation valve of claim 9, wherein the creating means comprises a passage coupled between the outlet port and an end of the spool.

12. The actuation valve of claim 11, wherein the moving means further comprises a spring in contact with the end of the spool.

13. The actuation valve of claim 9, wherein the spool includes a land which blocks fluid communication between the high pressure port and the outlet port when the spool is in the second position and which blocks fluid communication between the low pressure port and the outlet port when the spool is in the first position.

14. An actuation valve for a hydraulically-operated fuel injector having an intensifier piston disposed in an intensifier chamber, comprising:

a solenoid having a solenoid winding and a movable armature coupled to a plunger;

a spool valve having a high pressure port, a low pressure port, an outlet port coupled to the intensifier chamber and a spool movable to a first position by the solenoid when the solenoid winding is energized and also movable to a second position when the solenoid winding is deenergized to selectively place the high pressure port or the low pressure port in fluid communication with the outlet port and the intensifier piston;

a high pressure fluid source coupled to the high pressure port;

a low pressure fluid source coupled to the low pressure port;

a spring in contact with an end of the spool and disposed in a spring chamber;

the spool including a first land having one side in fluid communication with the spring chamber and a second side in fluid communication with the low pressure port when the spool is in the first position, a second land which blocks the outlet port from the low pressure port when the spool is in the first position and which blocks the outlet port from the high pressure port when the spool is in the second position; and a passage extending between the outlet port and the spring chamber for conducting high pressure fluid to the one side of the first land to assist the spring in moving the spool from the first position to the second position.

* * * * *